US006652669B1

(12) United States Patent
Reihs et al.

(10) Patent No.: US 6,652,669 B1
(45) Date of Patent: Nov. 25, 2003

(54) METHOD FOR PRODUCING AN ULTRAPHOBIC SURFACE ON AN ALUMINUM BASE

(75) Inventors: Karsten Reihs, Köln (DE); Daniel-Gordon Duff, Leverkusen (DE); Georg Wiessmeier, Köln (DE); Burkhard Koehler, Leverkusen (DE); Matthias Voetz, Köln (DE); Juan Gonzalez-Blanco, Köln (DE); Eckard Wenz, Köln (DE)

(73) Assignee: Sunyx Surface Nanotechnologies GmbH, Cologne (DE)

( * ) Notice: Subject to any disclaimer, the term of this patent is extended or adjusted under 35 U.S.C. 154(b) by 0 days.

(21) Appl. No.: 09/869,128

(22) PCT Filed: Dec. 22, 1999

(86) PCT No.: PCT/EP99/10324

§ 371 (c)(1),
(2), (4) Date: Aug. 27, 2001

(87) PCT Pub. No.: WO00/39368

PCT Pub. Date: Jul. 6, 2000

(30) Foreign Application Priority Data

Dec. 24, 1998 (DE) ..... 198 60 138

(51) Int. Cl.[7] ..... C23C 22/00

(52) U.S. Cl. ..... 148/241; 148/243; 148/275; 148/276; 148/285; 428/472.3; 427/343; 427/419.3; 205/102; 205/148; 205/149; 205/201; 205/324

(58) Field of Search ..... 148/241, 243, 148/275, 276, 285; 428/472.3; 427/343, 419.3; 205/102, 148, 149, 201, 324

(56) References Cited

U.S. PATENT DOCUMENTS

| | | | | |
|---|---|---|---|---|
| 4,097,312 A | | 6/1978 | Dorsey, Jr. | |
| 4,116,695 A | * | 9/1978 | Mori et al. | 101/454 |
| 4,960,635 A | | 10/1990 | Erdelen et al. | |
| 5,693,236 A | | 12/1997 | Okumura et al. | |
| 5,811,215 A | * | 9/1998 | Van Damme et al. | 101/459 |

FOREIGN PATENT DOCUMENTS

| | | |
|---|---|---|
| DE | 28 36 878 | 11/1979 |
| DE | 198 60 136 | 6/2000 |
| DE | 198 60 137 | 6/2000 |
| EP | 0 213 331 | 3/1987 |
| EP | 0 476 510 | 3/1992 |
| EP | 0 799 717 | 10/1997 |

OTHER PUBLICATIONS

The Royal Society of Chemistry, 13 pages, "A Directory of Surface Active Agents Available in Europe", 1995 (No month data).

Patent Abstracts of Japan, JP 03 100182, Apr. 25, 1991.

* cited by examiner

*Primary Examiner*—John P. Sheehan
*Assistant Examiner*—Andrew L. Ohmans
(74) *Attorney, Agent, or Firm*—Oblon, Spivak, McClelland, Maier & Neustadt, P.C.

(57) ABSTRACT

The invention relates to a method for producing an ultraphobic surface on aluminium as the supporting material and to the resulting surface and its use. According to said method, the surface of an aluminium support is anodized, especially by anodic oxidation, and/or electrochemically pickled in an acid solution with an alternating voltage, treated in hot water or water vapor at a temperature of 50 to 100° C., optionally coated with an adhesion promoter layer and then provided with a hydrophobic or especially oleophobic coating.

33 Claims, No Drawings

METHOD FOR PRODUCING AN ULTRAPHOBIC SURFACE ON AN ALUMINUM BASE

The present invention relates to a method for producing an ultraphobic surface on aluminum as support material, and to the surface obtained thereby and to its use. In the method, the surface of an aluminum support, optionally electrochemically pickled in acidic solution with alternating voltage, is anodized, in particular by anodic oxidation, treated in hot water or water vapor at a temperature of from 50 to 100° C., optionally coated with an adhesion promoter layer and then provided with a hydrophobic or, in particular, oleophobic coating.

Ultraphobic surfaces are characterized by the fact that the contact angle of a drop of liquid, usually water, on the surface is significantly more than 90° and that the roll-off angle does not exceed 10°. Ultraphobic surfaces having a contact angle of>150° and the abovementioned roll-off angle have a very great technical advantage because, for example, they are not wettable with water or with oil, soil particles adhere to these surfaces only very poorly and these surfaces are self-cleaning. Here, self-cleaning means the ability of the surface to readily give up soil or dust particles adhering to the surface to liquids which flow over the surface.

There has therefore been no lack of attempts to provide such ultraphobic surfaces. For example, EP 476 510 A1 discloses a method for producing an ultraphobic surface in which a metal oxide film is deposited on a glass surface and is then etched using an Ar plasma. However, the surfaces produced using this method have the disadvantage that the contact angle of a drop on the surface is less than 150°. U.S. Pat. No. 5,693,236 also discloses a plurality of methods for producing ultraphobic surfaces, in which zinc oxide microneedles are applied to a surface using a binder and are then partially uncovered in various ways (e.g. by plasma treatment). The surface structured in this way is then coated with a water-repelling composition. However, surfaces structured in this way likewise only have contact angles of around up to 150°.

The object was therefore to provide ultraphobic surfaces and a method for their production which have a contact angle of≧150°, and preferably a roll-off angle of ≦10°.

Here, the roll-off angle is the angle of inclination of a fundamentally planar but structured surface toward the horizontal at which a stationary drop of water of volume 10 $\mu$l is moved as a result of the gravitational force when the surface is inclined.

The object is [lacuna] according to the invention by the provision of a method for producing an ultraphobic surface on aluminum as support material, characterized in that the surface of an aluminum support is anodized, in particular by anodic oxidation, treated in hot water or water vapor at a temperature of from 50 to 100° C., optionally coated with an adhesion promoter layer and then provided with a hydrophobic or, in particular, oleophobic coating.

For the purposes of the invention, an aluminum surface is the surface of any molding made of aluminum or made of an alloy based on aluminum, and the surface of a molding made of any material to which an aluminum layer or a layer of an alloy based on aluminum has been applied, preferably by vapor deposition. A preferred aluminum-based alloy is $AlMg_3$.

A preferred alternative of the method is characterized in that, prior to the water or water vapor treatment and/or optionally the anodic oxidation in an aqueous acidic solution (≦pH 5), the surface is exposed to an electrical alternating voltage of >5 volts over a period of at least 5 sec, it also being possible for the water or water vapor treatment to be dispensed with.

The current density during the alternating voltage treatment is particularly preferably greater than 1 mA/cm$^2$.

In one variant of the method, prior to the water or water vapor treatment and/or prior to the anodic oxidation and/or prior to the alternating voltage treatment, the surface is advantageously exposed to an alkaline aqueous solution (pH≧9) for at least 10 sec.

This aluminum surface is optionally anodically oxidized. The anodic oxidation is preferably carried out in 0.6 to 1.4 n, particularly preferably 0.9 to 1.1 n, sulfuric acid, chromic acid, oxalic acid, phosphoric acid or mixture thereof, preferably with continuous electrolyte motion under, preferably, laminar flow conditions. The electrolyte temperature is preferably 16 to 24° C., particularly preferably 19 to 21° C. The counterelectrode used is preferably an $AlMg_3$ medium-hard electrode. The distance of this electrode from the aluminum surface is preferably 3 to 7 cm, particularly preferably 4 to 6 cm. The current density during the oxidation is preferably adjusted to 5 to 15 mA/cm$^2$, particularly preferably to 9 to 11 mA/cm$^2$.

After the anodic oxidation or as the first method step, the aluminum surface is sealed with hot water or water vapor. For this purpose, the surface is exposed to hot water or water vapor at 50 to 100° C. The water or the water vapor preferably has a temperature of from 90 to 100° C. The surface is likewise preferably sealed with hot water for 300 to 1000 seconds, very particularly preferably 500 to 800 seconds. Following the treatment with hot water or water vapor, the sample is preferably dried at a preferred temperature range from 70 to 90° C. for preferably 40 to 80 minutes.

The person skilled in the art knows that the hot-water treatment can also be carried out with a water/solvent mixture, in which case the surface is then preferably exposed to the vapor mixture.

After the treatment with hot water or water vapor, the surfaces thus obtained are provided with a hydrophobic or, in particular, oleophobic coating.

For the purposes of the invention, a hydrophobic material is a material which, on a level unstructured surface, has a contact angle based on water of greater than 90°.

For the purposes of the invention, an oleophobic material is a material which, on a level unstructured surface, has a contact angle based on long-chain n-alkanes, such as n-decanè, of greater than 90°.

The ultraphobic surface preferably has a coating with a hydrophobic phobicization auxiliary, in particular an anionic, cationic, amphoteric or nonionic, surface-active compound.

Compounds to be regarded as phobicization auxiliaries are surface-active compounds of any molar mass. These compounds are preferably cationic, anionic, amphoteric or nonionic surface-active compounds, as listed, for example, in the directory "Surfactants Europa, A Dictionary of Surface Active Agents available in Europe, edited by Gordon L. Hollis, Royal Socity of Chemistry, Cambridge, 1995.

Examples of anionic phobicization auxiliaries are: alkylsulfates, ether sulfates, ether carboxylates, phosphate esters, sulfosucinates, sulfosuccinate amides, paraffinsulfonates, olefinsulfonates, sarcosinates, isothionates, taurates and lingnin-based compounds.

Examples of cationic phobicization auxiliaries are quaternary alkylammonium compounds and imidazoles.

Amphoteric phobicization auxiliaries are, for example, betaines, glycinates, propionates and imidazoles.

Examples of nonionic phobicization auxiliaries are: alkoxylates, alkyloamides, esters, amino oxides and alky polyglycosides. Also suitable are: reaction products of alkylene oxides with alkylatable compounds, such as, for example, fatty alcohols, fatty amines, fatty acids, phenols, alkylphenols, arylalkylphenols, such as styrene/phenol condensates, carboxamides and resin acids.

Particular preference is given to phobicization auxiliaries in which 1 to 100%, particularly preferably 60 to 95%, of the hydrogen atoms are substituted by fluorine atoms. Examples which may be mentioned are perfluorinated alkylsulfate, perfluorinated alkylsulfonates, perfluorinated alkylphosphonates, perfluorinated alkylphosphinates and perfluorinated carboxylic acids.

As polymeric phobicization auxiliaries for the hydrophobic coating or as polymeric hydrophobic material for the surface, preference is given to compounds with a molar mass $M_w$>500 to 1,000,000, preferably 1000 to 500,000 and particularly preferably 1500 to 20,000. These polymeric phobicization auxiliaries may be nonionic, anionic, cationic or amphoteric compounds. In addition, these polymeric phobicization auxiliaries may be homo- and copolymers, graft polymers and graft copolymers, and random block polymers.

Particularly preferred polymeric phobicization auxiliaries are those of the type AB, BAB and ABC block polymers. In the AB or BAB block polymers, the A segment is a hydrophilic homopolymer or copolymer and the B block is a hydrophobic homopolymer or copolymer or a salt thereof.

Particular preference is also given to anionic polymeric phobicization auxiliaries, in particular condensation products of aromatic sulfonic acids with formaldehyde and alkylnaphthalenesulfonic acids or of formaldehyde, naphthalenesulfonic acids and/or benzenesulfonic acids, condensation products of optionally substituted phenol with formaldehyde and sodium bisulfite.

Also preferred are condensation products which are obtainable by reaction of naphthols with alkanols, additions of alkylene oxide and at least partial conversion of the terminal hydroxyl groups into sulfo groups or monoesters of maleic acid and phthalic acid or succinic acid.

In another preferred embodiment, the phobicization auxiliary is [lacuna] from the group of sulfosuccinates and alkylbenzenesulfonates. Also preferred are sulfated, alkoxylated fatty acids or salts thereof. Alkoxylated fatty acid alcohols means, in particular, those $C_6$–$C_{22}$-fatty acid alcohols which are saturated or unsaturated and have 5 to 120, 6 to 60, very particularly preferably 7 to 30, ethylene oxide units, in particular stearyl alcohol. The sulfated alkoxylated fatty acid alcohols are preferably in the form of a salt, in particular an alkali metal or amine salt, preferably diethylamine salt.

In order to improve the adhesion of the hydrophobic or oleophobic coating on the sealed surface, it may be advantageous to firstly coat the surface with an adhesion promoter layer. Therefore, an adhesion promoter layer is optionally applied between the sealed surface and the hydrophobic or oleophobic coating. In principle, the adhesion promoter may be any substance known to the person skilled in the art which increases the bonding between the surface and the respective hydrophobic or oleophobic coating. Preferred adhesion promoters, e.g. for thiols as hydrophobic coating, are noble metal layers e.g. of Au, Pt or Ag or those of GaAs, in particular of gold. The thickness of the adhesion promoter layer is preferably from 10 to 100 nm.

Using the method according to the invention it is possible to prepare ultraphobic surfaces for which the contact angle of a drop on the surface is ≧155°. The invention therefore also provides the ultraphobic surfaces obtained by the method according to the invention.

These ultraphobic surfaces have the advantage, inter alia, that they are self-cleaning, self-cleaning taking place when the surface is exposed from time to time to rain or moving water. As a result of the ultraphobic surface, the drops of water roll off the surface and soil particles, which adhere only very poorly to the surface, settle on the surface of the drops which are rolling off and are therefore removed from the ultraphobic surface. This self-cleaning is effective not only upon contact with water but also with oil.

There are a large number of industrial use possibilities for the surface produced by the method according to the invention. Also claimed, therefore, are the following uses of the ultraphobic surfaces produced by the method according to the invention:

Hulls can be coated with the ultraphobic surface produced by the method according to the invention in order to reduce their resistance to friction.

In addition, sanitary installations, in particular toilet bowls, can be provided with the ultraphobic surface produced by the method according to the invention in order to render them self-cleaning. As a result of the fact that water does not adhere to the ultraphobic surface produced by the method according to the invention, it is suitable as a rust inhibitor for base metals of any type.

A further use of the ultraphobic surface is the coating of surfaces to which no water must adhere in order to avoid icing over. Examples which may be mentioned here are the surfaces of heat exchangers, e.g. in refrigerators, or the surfaces of aircraft.

The surfaces produced by the method according to the invention are also suitable for fixing to house facades, roofs, monuments in order to render these self-cleaning.

The ultraphobic surfaces produced by the method according to the invention are also suitable, in particular, for the coating of moldings which are transparent. In particular, these may be transparent glazings of buildings, vehicles, solar collectors. For this, a thin layer of the ultraphobic surface according to the invention is applied to the molding by vapor deposition.

The invention also provides a material or construction material having an ultraphobic surface according to the invention.

The invention further provides for the use of the ultraphobic surface according to the invention for the friction-reducing lining of vehicle bodies, fuselages or hulls.

The invention also provides for the use of the ultraphobic surface according to the invention as self-cleaning coating or paneling of building structures, roofs, windows, ceramic construction material, e.g. for sanitary installations, household appliances.

The invention further provides for the use of the ultraphobic surface according to the invention as antirust coating of metal objects.

The method according to the invention is illustrated below by reference to examples, although these do not represent a limitation of the general inventive concepts.

EXAMPLES

Example 1 (Type B)

General description for the examples below:

As a method of producing the surface, an aluminum layer is structured and then provided with a hydrophobic coating. The aluminum layer which is used can be an Al sheet or an Al layer on another support. For the structuring, the following combinations of method steps are used:

Type A Treatment with hot water
Type B Anodization and treatment with hot water
Type C Electrochemical pickling and anodization
Type D Electrochemical pickling and anodization and treatment with hot water
Type E Electrochemical pickling and treatment with hot water Comparative examples which, having a hydrophobic coating, do not lead to ultraphobic surfaces:

Type F Anodization
Type G Electrochemical pickling

All combinations of method steps are followed by a treatment with a hydrophobic coating.

A roll-polished $AlMg_3$ sheet with an area of 20×50 $mm^2$ and a thickness of 0.5 mm was degreased with distilled chloroform. The sheet was then anodically oxidized in 1 n $H_2SO_4$ with continuous electrolyte motion at laminar current conditions. The electrolyte temperature was kept constant at 20° C. using a thermostat. The distance between the surface of the sheet and the counterelectrode of Al(99.5) medium-hard was 5 cm. The current density was adjusted to 10 $mA/cm^2$ during the anodic oxidation.

After the anodic oxidation, the sheet was rinsed for 5 minutes in distilled water and then for 1 minute in methanol and then dried at room temperature. After drying, the sheet was sealed in distilled water at 100° C. for 600 seconds in a beaker which had been repeatedly boiled in distilled water beforehand. After this treatment, the sheet was rinsed with methanol and dried at 80° C. in a drying cabinet for one hour.

The sheet treated in this way was coated with an about 50 nm-thick gold layer by atomization. This coating corresponds to the method which is also customary for the preparation in electronmicroscopy and is described by Klaus Wetzig, Dietrich Schulze, "In situ Scanning Electron Microscopy in Material Research", page 36–40, Akademie Verlag, Berlin 1995.

Finally, the gold layer of the sample was coated in a closed vessel with a few drops of a solution of n-decanethiol in ethanol (1 g/l) at room temperature for 24 hours, then rinsed with ethanol and dried. The surface has a static contact angle for water of >150°. A drop of water of volume 10 μl rolls off if the surface is inclined by<10°.

Example 2 (Type A)

In this case, the $AlMg_3$ sheet was treated exactly as in Example 1, but was not anodically oxidized.

In this example, the surface has a static contact angle for water of>160°. A drop of water of volume 10 μl rolls off if the surface is inclined by<5°.

Example 3 (Type B)

A roll-polished, anodically oxidized and sealed $AlMg_3$ sheet as in Example 1 was immersed for 5 hours at pH 7 into a 1% strength by weight solution of Fluowet PL80 (mixture of fluorinated $C_6$–$C_{10}$-alkylphosphonates of the general formula:

$$R_fPH_3H$$

and fluorinated $C_6$–$C_{10}$-alkylphosphinates of the general formula $$(R_f)_x\cdot(H)_{2-x}PO_2H$$

where x=1 or 2 and $R_f$=fluorinated $C_6$–$C_{10}$-alkyl radical) from Clariant, and then rinsed with water and dried at 60° C.

The surface has a static contact angle for water of>155°. A drop of water of volume 10 μl rolls off if the surface is inclined by<5°.

Example 4 (Type A)

In this case, the $AlMg_3$ sheet was treated exactly as in Example 3, but was not anodically oxidized. In the case of this example, the surface has a static contact angle for water of>155°. A drop of water of volume 10 μl rolls off if the surface is inclined by<5°.

Example 5 (Type C)

A roll-polished Al sheet with an area of 20×50 $mm^2$ and a thickness of 0.5 mm was treated with distilled chloroform, then in aqueous NaOH (5 g/l) at 50° C. for 20 sec.

It was then prepickled for 20 sec in $H_3PO_4$ (100 g/l), rinsed for 30 sec in dist. water and electrochemically pickled for 90 sec in a mixture of $HCl/H_3BO_3$ (in each case 4 g/l) at 35° C. and 120 $mA/cm^2$ at an alternating voltage of 35 V.

After rinsing in dist. water for 30 sec and alkaline rinsing in 5 g/l of aqueous NaOH for 30 sec, the sheet was again rinsed in dist. water for 30 sec and then anodically oxidized for 90 sec in $H_2SO_4$ (200 g/l) at 25° C. with a current density of 30 $mA/cm^2$ at a direct voltage of 50 V.

The sheet was then rinsed in dist. water for 30 sec, then at 40° C. in $NaHCO_3$ (20 g/l) for 60 sec, then again in dist. water for 30 sec and dried.

The sheet treated in this way was coated with an approximately 50 nm-thick gold layer by atomization. Finally, the sample was coated in a closed vessel with a few drops of a solution of n-decanethiol in ethanol (1 g/l) at room temperature for 24 hours, then rinsed with ethanol and dried.

The surface has a static contact angle for water of>165°. A drop of water of volume 10 μl rolls off if the surface is inclined by<10°.

Example 6 (Type D)

In this example, the sheet was treated as in Example 5 after the anodic oxidation in a beaker in distilled water at 100° C. for 600 seconds. After this treatment, the sheet was rinsed with methanol and dried at 80° C. in a drying cabinet for one hour. The procedure was then continued as described in Example 5.

The surface has a static contact angle for water of>172°. A drop of water of volume 10 μl rolls off if the surface is inclined by<10°.

Example 7 (Type E)

The procedure here was as in Example 6, but without anodic oxidation. The surface has a static contact angle for water of>152°. A drop of water of volume 10 μl rolls off if the surface is inclined by<10°.

Example 8 (Type D)

Instead of the Al sheet in Example 5, a 3 μm-thick Al layer was used which had been applied to a glass support by atomization.

The surface has a static contact angle for water of>168°. A drop of water of volume 10 μl rolls off if the surface is inclined by<10°.

Comparative Example 9 (Type F)

A roll-polished Al sheet with an area of 20×50 $mm^2$ and a thickness of 0.5 mm was treated with distilled chloroform and then in aqueous NaOH (5 g/l) at 50° C. for 20 sec. After rinsing in dist. water for 30 sec, the sheet was anodically oxidized for 90 sec in $H_2SO_4$ (200 g/l) at 25° C. with a current density of 30 mA/cm$^2$ at a direct voltage of 50 V.

The sheet was then rinsed in dist. water for 30 sec and dried.

The sheet treated in this way was coated with an approximately 50 nm-thick gold layer by atomization. Finally, the sample was coated in a closed vessel with a few drops of a solution of n-decanethiol in ethanol (1 g/l) at room temperature for 24 hours, then rinsed with ethanol and dried.

The surface has a static contact angle for water of>131°. No drops of water roll off if the surface is inclined up to 90°.

Comparative Example 10 (Type F)

An Al sheet was pretreated overall as in Comparative Example 9, then anodically oxidized for 5 min and further treated. The surface has a static contact angle for water of>129°. No drops of water roll off if the surface is inclined up to 90°.

Comparative Example 11 (Type G)

A roll-polished Al sheet as Example 5 was treated with distilled chloroform and then in aqueous NaOH (5 g/l) at 50° C. for 20 sec.

The sheet was then prepickled for 20 sec in $H_3PO_4$ (100 g/l), then rinsed in dist. water for 30 sec and then electrochemically pickled for 90 sec in a mixture of $HCl/H_3BO_3$ (in each case 4 g/l) at 35° C. and at a current density of 120 mA/cm$^2$ at an alternating voltage of 35 V.

The sheet was then rinsed in dist. water for 30 sec, then at 40° C. in $NaHCO_3$ (20 g/l) for 60 sec then again in dist. water for 30 sec and dried.

The sheet treated in this way was coated with an approximately 50 nm-thick gold layer by atomization. Finally, the sample was coated in a closed vessel with a few drops of a solution of n-decanethiol in ethanol (1 g/l) at room temperature for 24 hours, then rinsed with ethanol and dried.

The surface has a static contact angle for water of>139°. No drops of water roll off if the surface is inclined at between 90°.

What is claimed is:

1. A method for producing an ultraphobic surface that has a contact angle of ≧150° and a roll-off angle of ≦10° comprising:

(1) treating an aluminum or aluminum-alloy support using one of the following series of steps (C), (D) or (E):

(C) electrochemical pickling by exposing the aluminum or aluminum-alloy support surface to an electrical alternating voltage of>5 volts over a period of at least 5 sec, followed by anodizing the surface, (D) electrochemical pickling by exposing the aluminum or aluminum-alloy support surface to an electrical alternating voltage of>5 volts over a period of at least 5 sec, followed by anodizing the surface, followed by treatment in hot water or water vapor at a temperature of from 50 to 100° C., or (E) electrochemical pickling by exposing the aluminum or aluminum-alloy support surface to an electrical alternating voltage of>5 volts over a period of at least 5 sec, followed by treatment in hot water or water vapor at a temperature of from 50 to 100° C.;

(2) optionally coating said surface with an adhesion promoter layer; and (3) providing said surface with a hydrophobic or oleophobic coating to form an ultraphobic surface, on said aluminum aluminum-alloy support material or on said adhesion promoter layer wherein said ultraphobic surface has a contact angle of ≧150° and a roll-off angle of ≦10°.

2. The method according to claim 1, comprising providing said surface with a hydrophobic coating.

3. The method according to claim 1, wherein series, (C) or (D) is carried out, and the surface of the aluminum or aluminum-alloy support is anodized following prerinsing with an acidic aqueous solution (pH≦4) over a period of≧10 sec.

4. The method according to claim 1, wherein series, (C) or (D) is carried out, and the surface of the aluminum or aluminum-alloy support is anodized by anodic oxidation.

5. The method according to claim 1, comprising providing said surface with an oleophobic coating.

6. The method according claim 1, wherein, prior to step (1), the surface is exposed to an alkaline aqueous solution (pH≧9) for at least 10 sec.

7. The method according to claim 1, wherein series, (D) or (E) is carried out, and the surface is treated in hot water or water vapor for 300 to 1000 seconds.

8. The method according to claim 7, wherein the surface is treated in hot water or water vapor for 500 to 800 seconds.

9. The method according to claim 8, wherein the temperature of the water or water vapor is from 90 to 100° C.

10. The method according to claim 9, wherein the surface is dried following the treatment with hot water or water vapor.

11. The method according to claim 4, wherein the surface is anodically oxidized in the presence of concentrated mineral acids.

12. The method according to claim 4, wherein the surface is anodically oxidized in the presence of sulfuric acid, chromic acid, oxalic acid, phosphoric acid or mixture thereof.

13. The method according to claim 4, wherein the surface is anodically oxidized in the presence of at least one concentrated mineral acid with continuous electrolyte motion.

14. The method according to claim 2, wherein the aluminum surface, following step (1), is coated with a tin layer of noble metal as the adhesion promoter layer.

15. The method according to claim 2, wherein the aluminum surface, following step (1), is coated with a thin layer of gold as the adhesion promoter layer.

16. The method according to claim 2, wherein the aluminum surface, following step (1), is coated with a thin layer of noble metal of 10 to 100 nm in thickness as the adhesion promoter layer by precipitation.

17. The ultraphobic surface-coated aluminum obtained by a method according to claim 1.

18. A material comprising an ultraphobic surface-coated aluminum obtained by a method according to claim 1.

19. A method for reducing friction comprising lining a vehicle body, fuselage or hulls with an ultraphobic surface-coated aluminum obtained by a method according to claim 1.

20. The method of claim 1, further comprising incorporating said ultraphobic surface into a building structure, roof, window, sanitary installation, household appliance, or ceramic construction material.

21. A method for rust protection comprising coating a metal object with an ultraphobic surface-coated aluminum obtained by a method according to claim 1.

22. A method to produce an ultraphobic transparent molding comprising coating a transparent molding with an ultraphobic surface-coated aluminum obtained according to claim 1.

23. A method to produce an ultraphobic transparent sheet comprising top coating a transparent sheet with an ultraphobic surface-coated aluminum obtained by a method according to claim 1.

24. A method to produce an ultraphobic transparent glass or plastic sheet comprising top coating a transparent glass or plastic sheet with an ultraphobic surface-coated aluminum obtained by a method according to claim 1.

25. A method to produce ultraphobic transparent sheet for a solar cell, vehicle or greenhouse comprising top coating a transparent sheet for a solar cell, vehicle or greenhouse with an ultraphobic surface-coated aluminum obtained by a method according to claim 1.

26. The method according to claim 1, wherein series (C) is carried out.

27. The method according to claim 1, wherein series (D) is carried out.

28. The method according to claim 1, wherein series (E) is carried out.

29. The method according to claim 2, wherein the hydrophobic coating comprises a thiol.

30. The method according to claim 14, wherein the hydrophobic coating comprises a thiol.

31. The method according to claim 29, wherein the thiol is n-decanethiol.

32. The method according to claim 30, wherein the thiol is n-decanethiol.

33. The method according to claim 1, wherein the support is $AlMg_3$.

* * * * *